US007329133B2

(12) United States Patent
Ishikawa

(10) Patent No.: US 7,329,133 B2
(45) Date of Patent: Feb. 12, 2008

(54) CONNECTOR

(75) Inventor: Yoshiyuki Ishikawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/787,011

(22) Filed: Apr. 13, 2007

(65) Prior Publication Data

US 2007/0249206 A1 Oct. 25, 2007

(30) Foreign Application Priority Data

Apr. 20, 2006 (JP) ..... 2006-116531

(51) Int. Cl.
*H01R 13/62* (2006.01)

(52) U.S. Cl. ..... 439/157; 439/140; 439/372

(58) Field of Classification Search ..... 439/372, 439/157, 267, 141, 147, 152, 153, 159, 140, 439/160

See application file for complete search history.

(56) References Cited

U.S. PATENT DOCUMENTS 5,269,696 A 12/1993 Okada et al.
6,095,833 A * 8/2000 Osawa ..... 439/157
6,193,531 B1 * 2/2001 Ito et al. ..... 439/157
6,623,285 B2 * 9/2003 Nishide ..... 439/140
2001/0039144 A1 11/2001 Osawa et al.

FOREIGN PATENT DOCUMENTS

EP 0 532 366 A1 3/1993
EP 1 150 393 A2 10/2001
JP 11-097105 4/1999

* cited by examiner

*Primary Examiner*—Edwin A. Leon
(74) *Attorney, Agent, or Firm*—Gerald E. Hespos; Anthony J. Casella

(57) ABSTRACT

A connector has a male housing (10) with a receptacle (11) and a moving plate (14) is disposed in the receptacle (11). A female housing (20) can fit in the receptacle (11) and in the moving plate (14). First cam followers (13F, 13R) project in from the inner peripheral surface of the receptacle (11). Second cam followers 17F, 17R project out from the outer peripheral surface of the moving plate (14) towards the inner peripheral surface of the receptacle (11). A lever (30) is mounted rotatably on the female housing (20). Outer surfaces of the lever (30) have first cam grooves (34F, 34R) for engaging the cam followers (13F, 13R) of the receptacle (11) and inner surfaces of the lever (30) have second cam grooves (35F, 35R) for engaging the cam followers (17F, 17R) of the moving plate (14).

8 Claims, 13 Drawing Sheets

CONNECTOR

BACKGROUND OF THE INVENTION

1. Field of the Invention

The invention relates to a connector with a movable member to assist connection.

2. Description of the Related Art

Japanese Unexamined Patent Publication No. H11-97105 discloses a connector that has a female housing, a male housing, a lever and a moving plate. The male housing has a receptacle that is configured to receive the female housing and male terminal fittings project into the receptacle. The receptacle is formed with escaping grooves for receiving cam followers that project from outer surfaces of the female housing. The lever an operable portion and arms extend from opposite ends of the operable portion. The arms are supported rotatably on outer surfaces of the male housing. Cam grooves are formed in the inner surfaces of the arms and engage with the cam followers of the female housing. The housings are connected and separated by rotating the lever while the cam followers are in the cam grooves.

The moving plate is disposed in the receptacle and is formed with positioning holes. The positioning holes receive the leading ends of the male terminal fittings before the housings are connected and align the male terminal fittings. Cam followers are formed on the outer lateral edges of the moving plate and project out through cut grooves of the receptacle. The cam followers of the moving plate engage cam grooves formed in the inner surfaces of the arms. Thus, the moving plate moves towards the back of the receptacle as the housings are connected by the lever, and returns towards the opening of the receptacle as the housings are separated.

The lever of the connector of Japanese Unexamined Patent Publication No. H11-97105 requires cam grooves for engaging the cam followers of the female housing and cam grooves for engaging the cam followers of the moving plate. The cam grooves must be designed to avoid interference (overlapping and/or crossing). Therefore, the degree of design freedom is reduced.

The invention was developed in view of the above problem, and an object thereof is to increase the degree of freedom for designing cam grooves for a lever with two kinds of cam grooves for a housing and a moving plate.

SUMMARY OF THE INVENTION

The invention relates to a connector with a first housing, a second housing and a movable member to connect and separate the housings. The first housing includes first terminal fittings and a moving plate that is movable in the first housing while permitting the first terminal fittings to pass therethrough. The first housing has at least one first cam follower and the moving plate has at least one second cam follower. The movable member is supported on the second housing for movement along the outer surface of the second housing. At least one first cam groove is formed in one surface of the movable member and is engageable with the first cam follower. At least one second cam groove is formed in a surface of the movable member substantially opposite the surface with the first cam groove and is engageable with the second cam follower.

The first cam groove for engaging the cam follower of the second housing and the second cam groove for engaging the cam follower of the moving plate are formed on separate surfaces of the movable member. Therefore, the courses of the cam grooves can be designed without considering avoiding interference of the cam grooves. Accordingly, the degree of freedom in design is higher.

The first housing preferably includes a receptacle at least partly surrounding the first terminal fittings. The moving plate is movable in the receptacle while permitting the first terminal fittings to pass therethrough.

The first cam follower preferably projects from the inner peripheral surface of the receptacle.

The at least one second cam follower preferably projects from the moving plate and towards the inner peripheral surface of the receptacle.

The at least one first cam groove for engaging the first cam follower preferably is formed on the outer surface of the movable member, and the at least one second cam groove for engaging the second cam follower preferably is formed in the inner surface of the movable member.

The movable member preferably has two arms arranged with the second housing therebetween. The second cam groove preferably is formed in the inner surface of each arm.

Two second cam followers preferably are formed on the moving plate at positions deviated in opposite directions from a widthwise middle position. Accordingly, the moving plate will not incline about the engaged positions of the second cam grooves and the second cam followers.

A seal ring may be provided on the moving plate for fluid-proofing.

The first cam followers and/or the second cam followers preferably are arranged asymmetrically with respect to the width direction.

Entrances of the second cam grooves preferably open at the outer peripheral edges of the arms at different positions when seen along an operation direction of the movable member.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
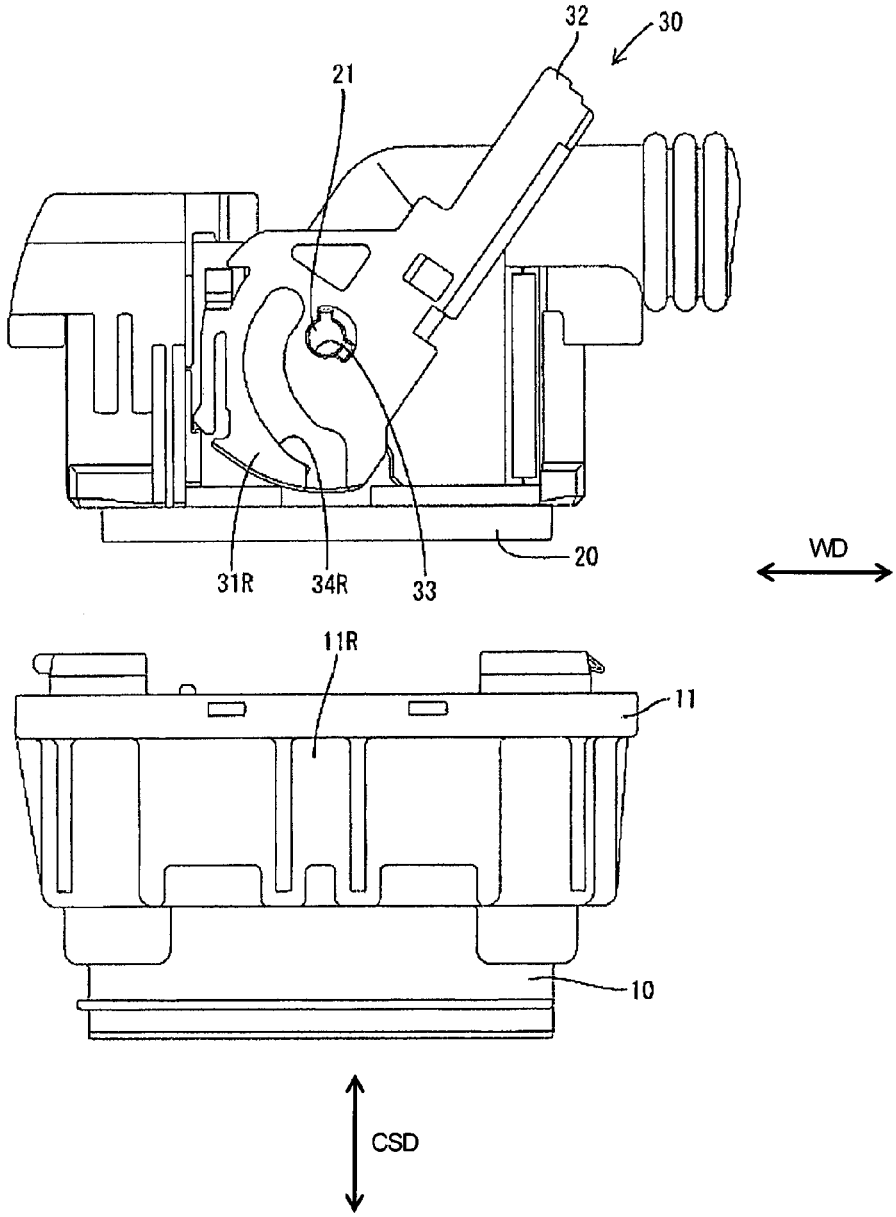
FIG. 1 is a rear view showing a separated state of a male housing and a female housing according to a first embodiment.
Figure 2:
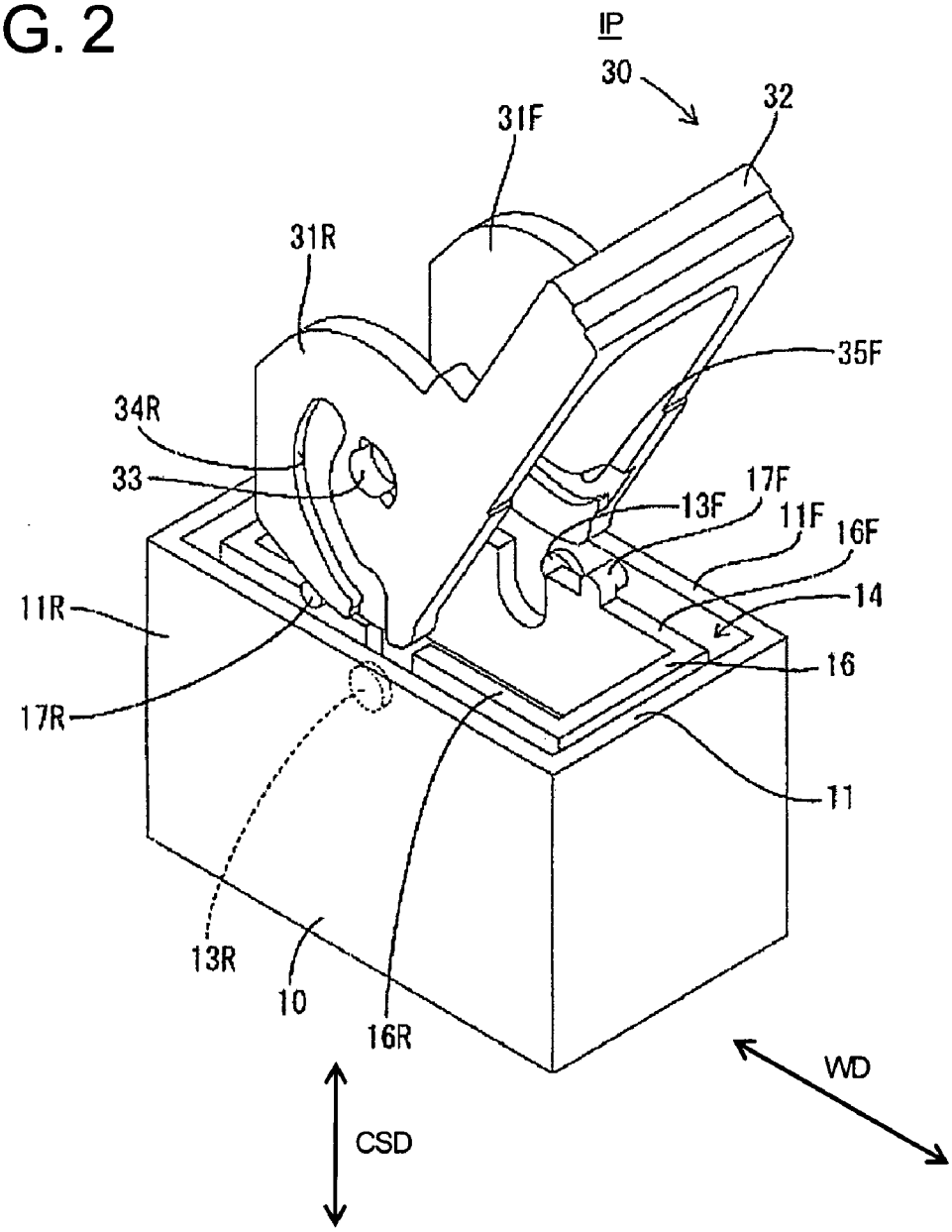
FIG. 2 is a perspective view showing a receptacle, a moving plate and a lever of the male housing.
Figure 3:
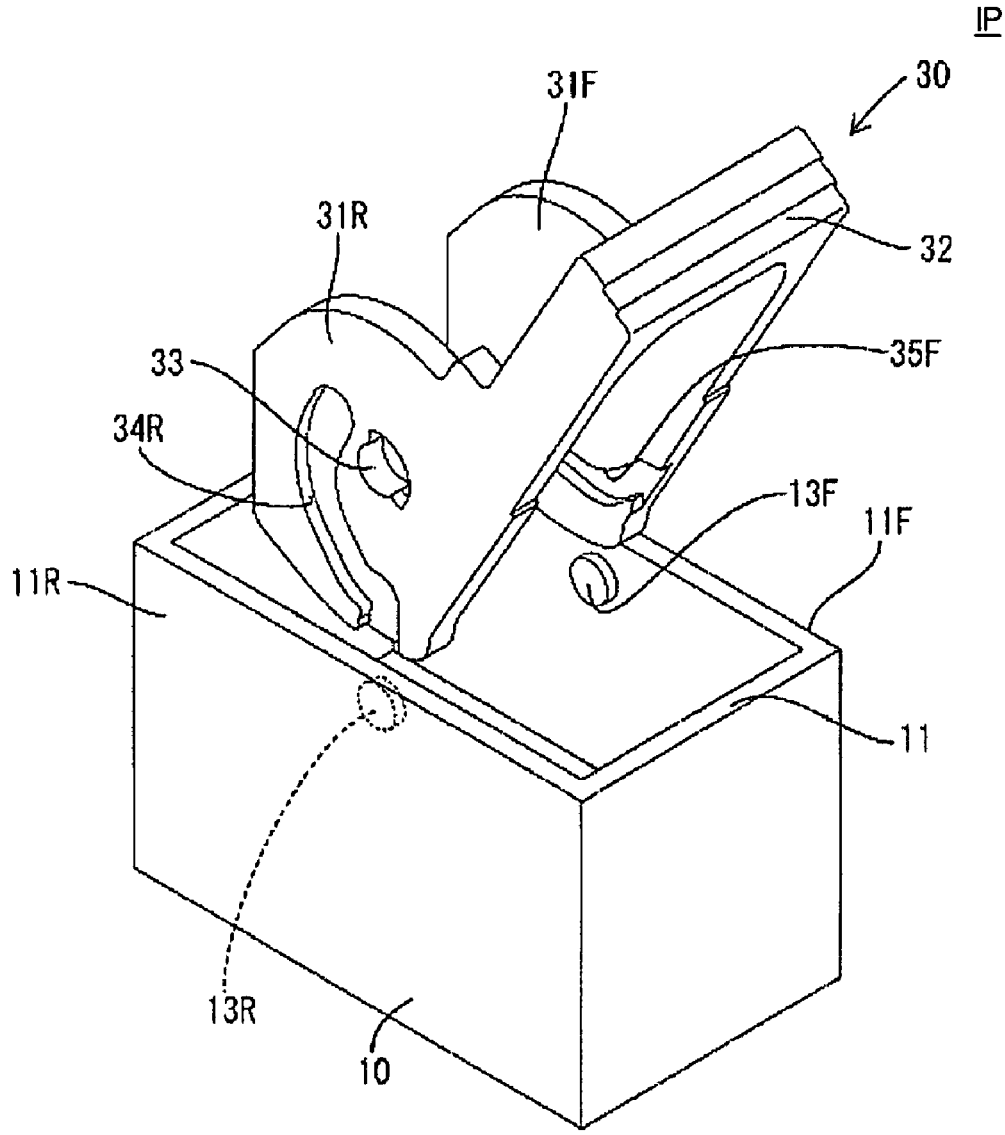
FIG. 3 is a perspective view showing the receptacle and the lever.
Figure 4:
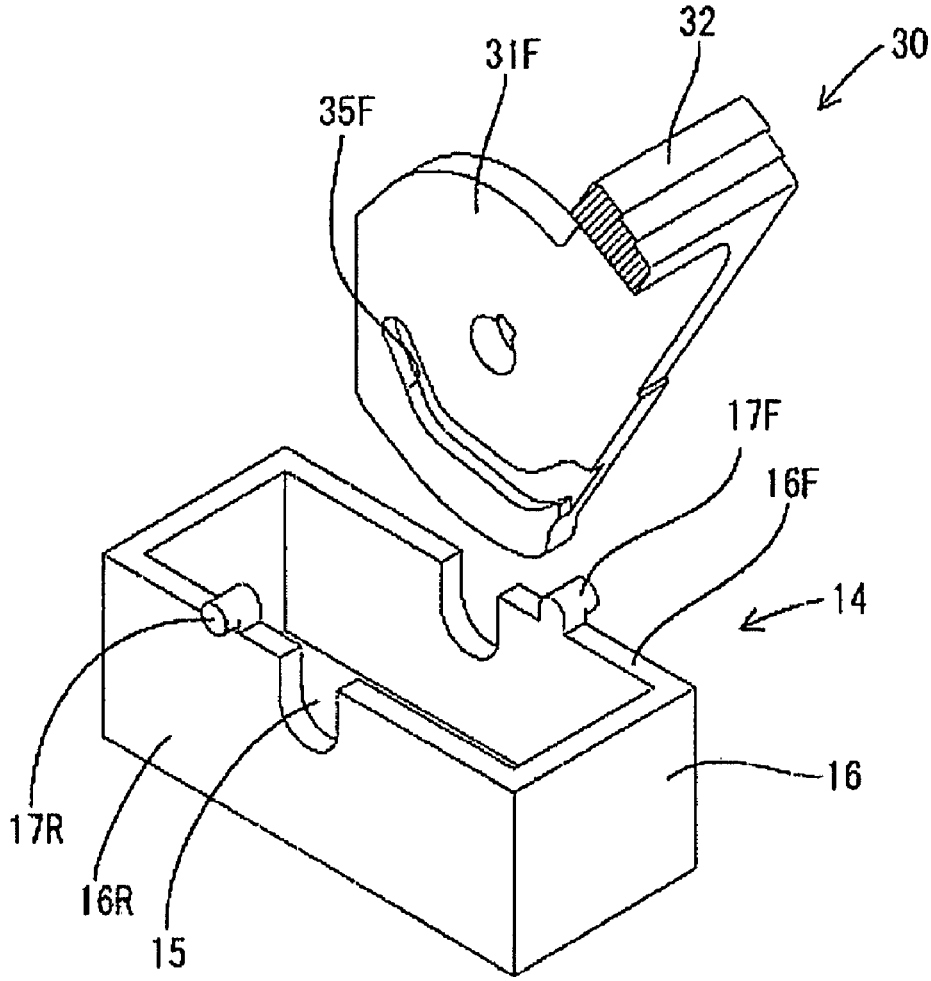
FIG. 4 is a perspective view partly cut away showing the moving plate and the lever.
Figure 5:
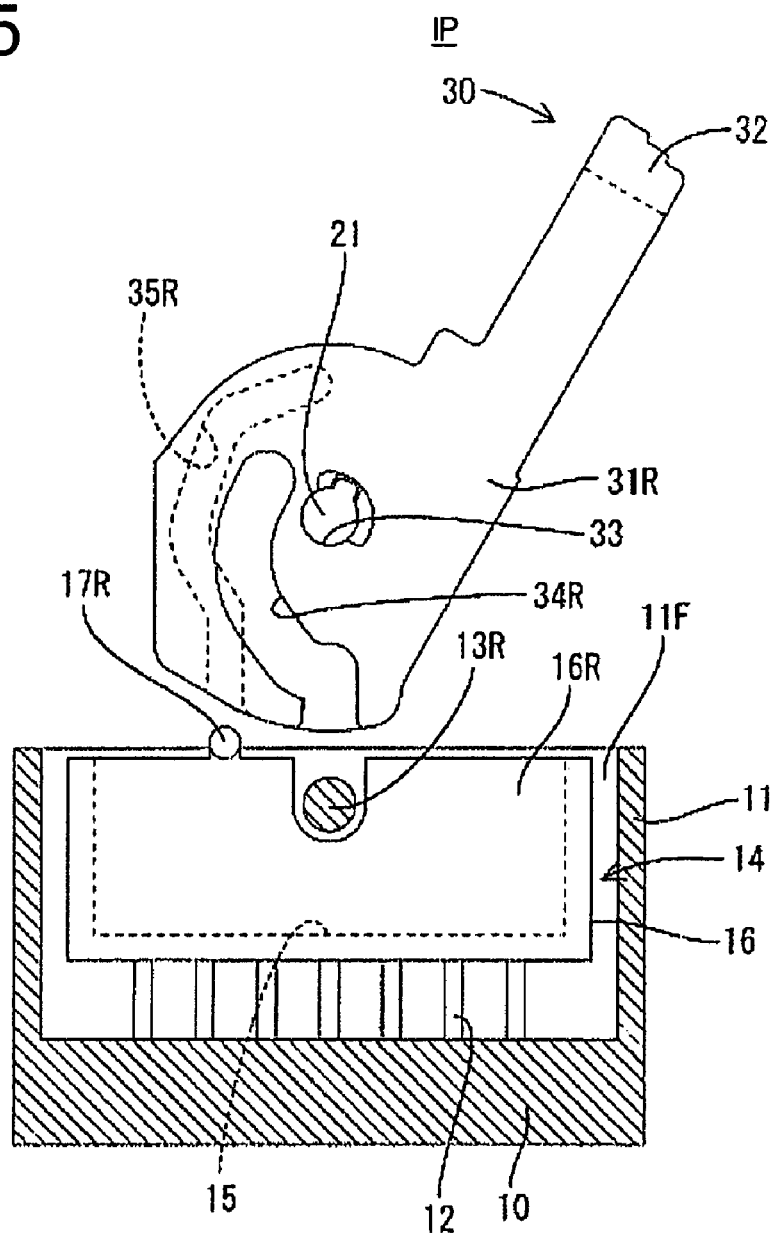
FIG. 5 is a section showing a state before the two housings are connected.

A lever-type connector according to a first embodiment of the invention is described with reference to FIGS. 1 to 10. The lever-type connector has a male housing 10 and a female housing 20 that are connected and separated utilizing a lever 30. Precise side views of the male housing 10 and the female housing 20 are shown in FIG. 1. However, FIGS. 2 to 10 omit the female housing 20 and show a simplified shape for the male housing 10. Connecting ends of the housings 10, 20 are referred to herein as the front.

The male housing 10 has a rectangular tubular receptacle 11 that extends up towards the front. Long narrow tabs 12 of male terminal fittings project up substantially parallel to connecting and separating directions CSD of the housings 10, 20 from the back surface at the bottom of the receptacle 11. Thus, the tabs 12 are surrounded by the receptacle 11. Front and rear first cam followers 13F, 13R are formed respectively on a front plate 11F and a rear plate 11R of the receptacle 11 at substantially widthwise middle positions near the opening of the receptacle 11. The first cam followers 13F, 13R are substantially cylindrical and project back from the inner surface of the front plate 11F and forward from the inner surface of the rear plate 11R. Further, the first cam followers 13F, 13R are substantially coaxial with one another.

A moving plate 14 is accommodated in the receptacle 11 for movement substantially vertically and substantially parallel with the connecting and separating directions CSD of the housings 10, 20. The moving plate 14*a* rectangular plate-shaped main portion 15 arranged substantially normal to the connecting and separating directions CSD of the housings 10, 20, and a rectangular tubular surrounding wall 16 extends substantially perpendicularly up from the outer peripheral edge of the main portion 15. Positioning holes 15H penetrate the main portion 15 at positions corresponding to the tabs 12. The moving plate 14 is guided by guiding means (not shown) formed on the outer peripheral surface of the surrounding wall 16 and the inner peripheral surface of the receptacle 11 for guiding the moving the moving plate 14 substantially parallel with the connecting and separating directions CSD of the two housings 10, 20 with specified clearances defined to the front plate 11F and the rear plate 11R of the receptacle 11. A known construction, such as the engagement of ribs and grooves, can be used as the guiding means.

Second cam followers 7F, 17R are formed respectively on or at or near a front wall 16F and a rear wall 16R of the surrounding wall 16. The second cam followers 17F, 17R are formed at positions slightly above the opening edge of the surrounding wall 16, and have substantially cylindrical shapes with axes substantially parallel with those of the first cam followers 13F, 13R. The second cam follower 17F projects forward from the front wall 16F towards the inner surface of the front plate 11F at a position deviated laterally (e.g. to right) from the widthwise center, whereas the second cam follower 17R projects back from the rear wall 16R towards the inner surface of the rear plate 11R at a position deviated laterally (e.g. to left) from the widthwise center. Accordingly, the first cam followers 13F, 13R and the second cam followers 17F, 17R are asymmetrically arranged with respect to the width direction WD, which is normal to the connecting and separating directions CSD of the two housings 10, 20.

The female housing 20 is connected with the male housing 10 by being fit partly into the receptacle 11 and into a space enclosed by the surrounding wall 16 of the moving plate 14. Two substantially cylindrical coaxial shafts 21 extend forward and back from the outer front and rear surfaces of the female housing 20. The shafts 21 are substantially normal to the connecting and separating directions CSD of the two housings 10, 20 and normal to the width direction WD. The lever 30 is mounted rotatably on the shafts 21.

The lever 30 has front and rear arms 31F, 31R that are connected by an operable portion 32. A bearing hole 33 penetrates each of the arms 31F, 31R in forward and backward directions. The lever 30 is assembled by arranging the arms 31F, 31R along the front and rear surfaces of the female housing 20 and engaging the bearing holes 33 with the shafts 21. The lever 30 can be moved rotatably about the shafts 21 between an initial position IP and a connecting position CP.

The outer surfaces of the front and rear arms 31F, 31R are recessed to form first cam grooves 34F, 34R curved around the bearing holes 33. The front and rear first cam grooves 34F, 34R are substantially identical so that the widths and courses thereof are in agreement when viewed in forward and backward directions. The inner surfaces of the front and rear arms 31F, 31R are recessed to form second cam grooves 35F, 35R curved around the bearing holes 33. Although the front and rear second cam grooves 35F, 35R are substantially identically shaped, the widths and courses thereof are not in agreement when viewed in forward and backward directions. More particularly, the front and rear second cam grooves 35F, 35R are shifted circumferentially by a specified angle about the bearing holes 33. Accordingly, the entrances of the front and rear second cam grooves 35F, 35R open at the outer peripheral edges of the arms 31F, 31R at different positions when seen along an operation direction of the lever 30 and when seen with respect to the axis of the shafts 21 and bearing holes 33.

Before the housings 10, 20 are connected, the moving plate 14 is positioned temporarily at an aligning position AP (see FIGS. 8 and 9) by unillustrated known locking means. In this state, the leading ends of the tabs 12 are located in the positioning holes 15H so that the tabs 12 are aligned to correspond to female terminal fittings (not shown) mounted in the female housing 20. Further, the lever 30 is positioned temporarily at the initial position IP (see FIGS. 8 and 9) relative to the female housing 20 by unillustrated locking means. With the lever 30 at the initial position IP, the entrances of the first cam grooves 34F, 34R and the second cam grooves 35F, 35R correspond to the first cam followers 13F, 13R and the second cam followers 17F, 17R.

Figure 6:
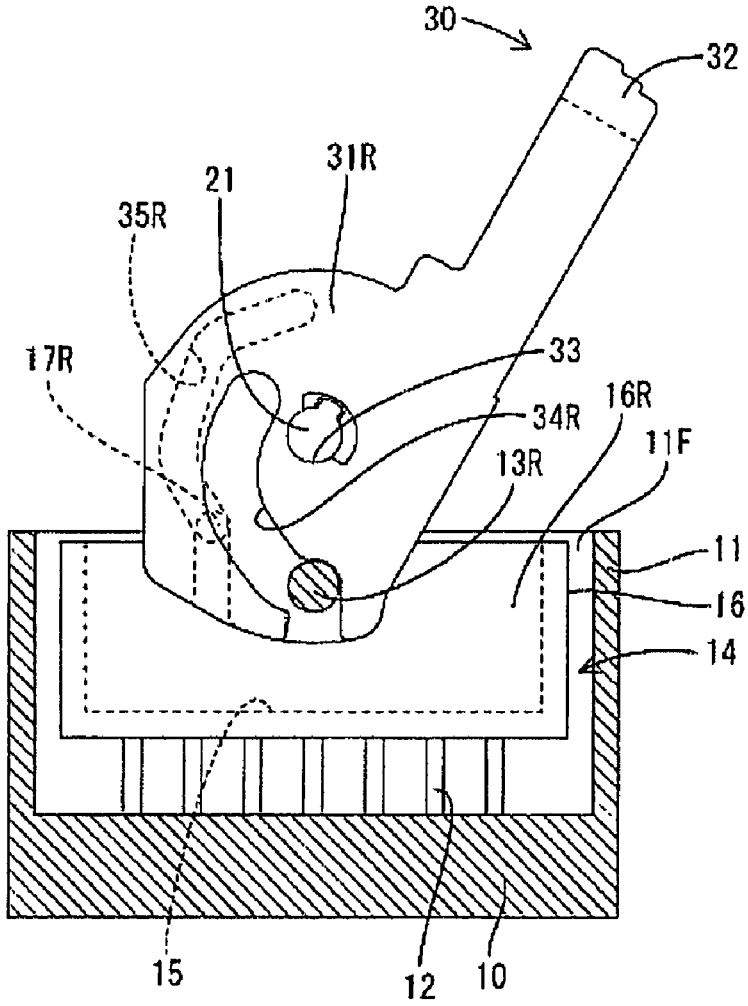
FIG. 6 is a section showing a state where the two housings are lightly fitted to locate cam followers at the entrances of cam grooves.
Figure 7:
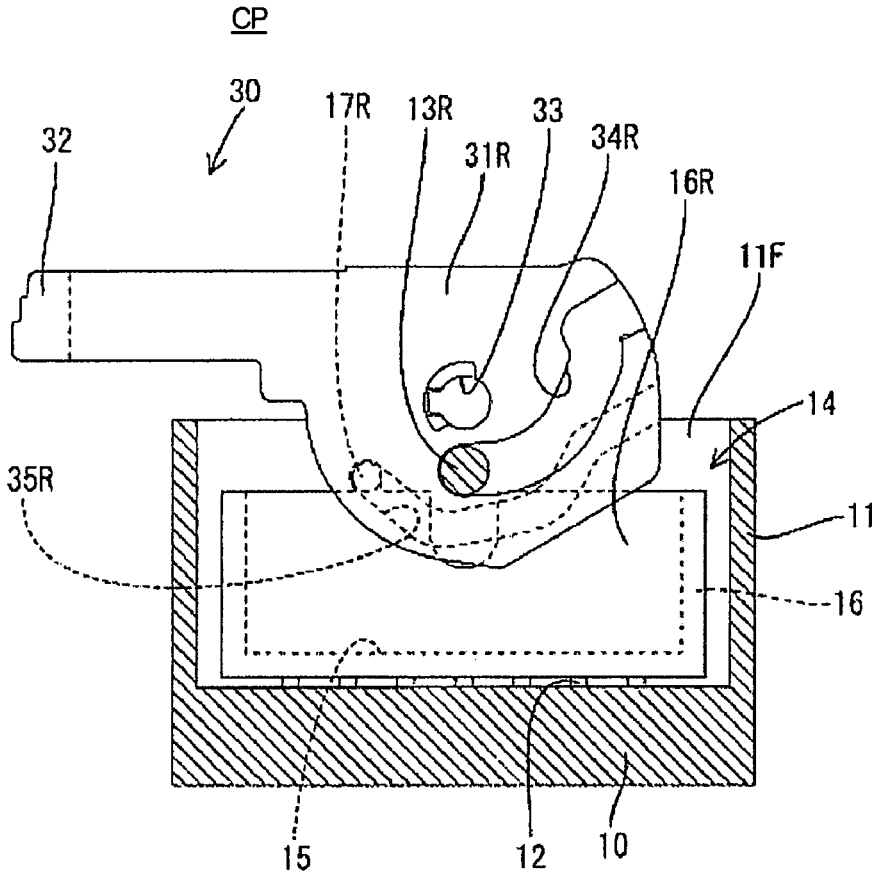
FIG. 7 is a section showing a state where the two housings are properly connected.
Figure 8:
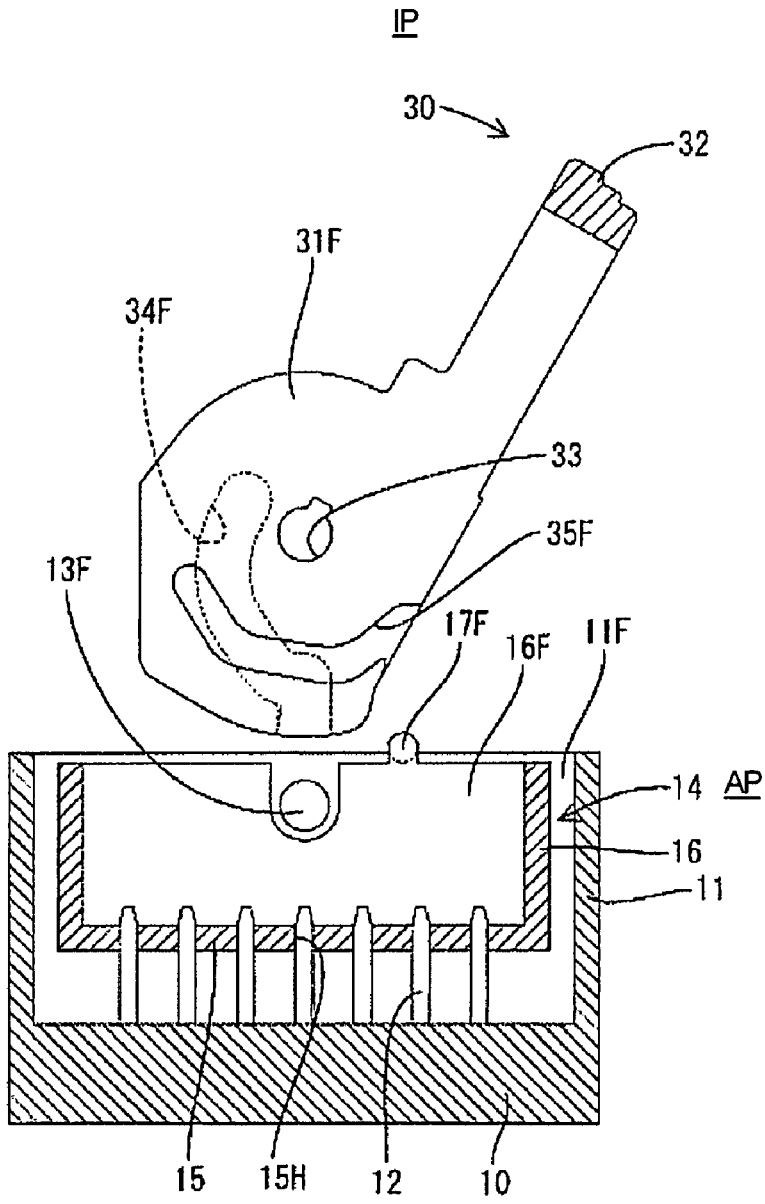
FIG. 8 is a section showing a state before the two housings are connected.
Figure 9:
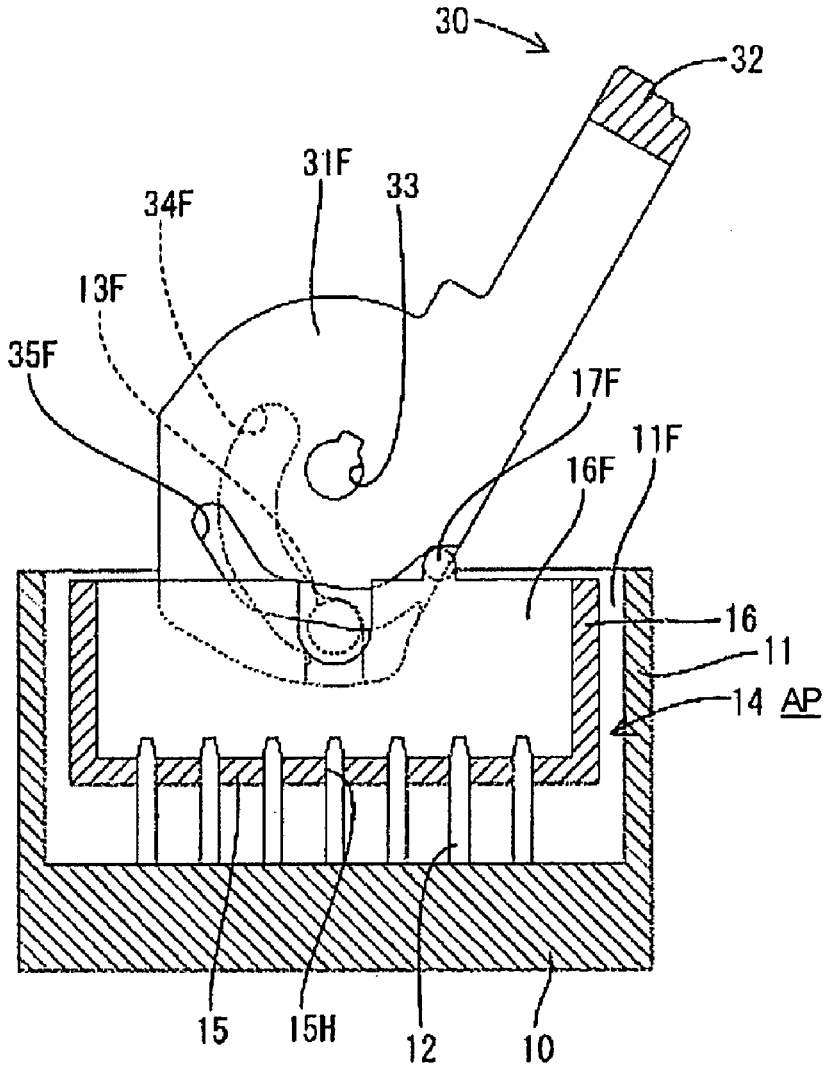
FIG. 9 is a section showing the state where the two housings are lightly fitted to locate the cam followers at the entrances of the cam grooves.
Figure 10:
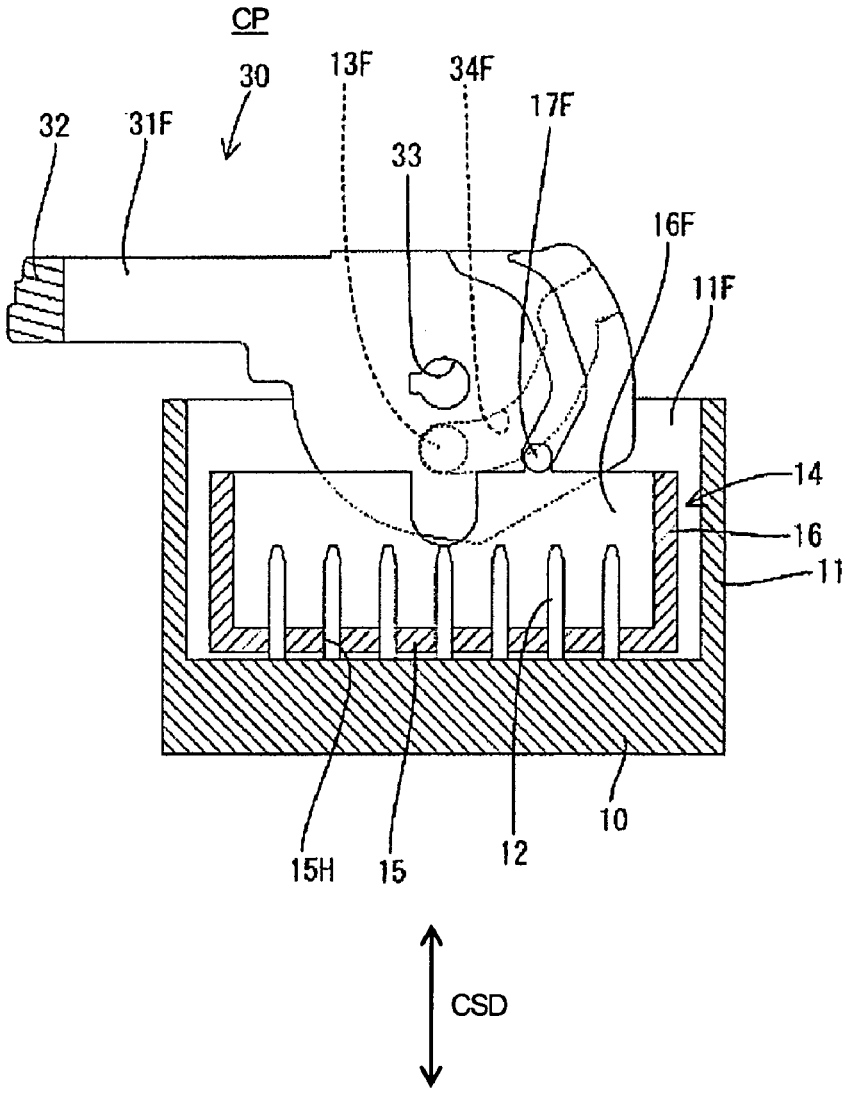
FIG. 10 is a section showing the state where the two housings are properly connected.

The bottom end of the female housing 20 then is fit lightly into the receptacle 11 and into the moving plate 14. Thus, the bottom ends of the arms 31F, 31R are inserted into clearances between the front plate 11F of the receptacle 11 and the front wall 16F of the moving plate 14 and between the rear plate 11R and the rear wall 16R. Accordingly, the first cam followers 13F, 13R enter the first cam grooves 34F, 34R and the second cam followers 17F, 17R enter the second cam grooves 35F, 35R, as shown in FIGS. 6 and 9.

The lever 30 then is rotated towards the connecting position CP. As a result, the housings 10, 20 are pulled towards each other by the cam action of the first cam grooves 34F, 34R and the first cam followers 13F, 13R. As the female housing 20 moves towards the male housing 10 by the rotation of the lever 30, the female housing 20 and the moving plate 14 move towards the back side of the receptacle 11 (down in FIGS. 5 to 10) while moving slightly toward or away from each other. The positioning holes 15H move from the leading ends of the tabs 12 toward the base ends as the moving plate 14 moves.

The two housings 10, 20 are connected properly when the lever 30 is rotated to the connecting position CP and the moving plate 14 reaches a retracted position (see FIG. 10) where the positioning holes 15H engage the base ends of the tabs 12.

The lever 30 is rotated from the connecting position CP to the initial position IP for separating the two properly connected housings 10, 20. The engagement of the first cam grooves 34F, 34R and the first cam followers 13F, 13R causes the two housings 10, 20 to separate gradually from each other as the lever 30 is rotated. Additionally, the engagement of the second cam grooves 35F, 35R and the second cam followers 17F, 17R causes the moving plate 14 and the female housing 20 to move towards the entrance of the receptacle 11 as the lever is rotated. The first cam followers 13F, 13R are substantially at the entrances of the first cam grooves 34F, 34R and the second cam followers 17F, 17R are substantially at the entrances of the second cam grooves 35F, 35R when the lever 30 reaches the initial position IP. Thus, the female housing 20 and the lever 30 can be separated from the receptacle 11 and the moving plate 14. Thereafter, the lever 30 may be detached from the male housing 10 together with the female housing 20.

As described above, the first cam grooves 34F, 34R for engaging the first cam followers 13F, 13R of the female housing 20 and the second cam grooves 35F, 35R for engaging the second cam followers 17F, 17R of the moving plate 14 are formed separately in the outer and inner surfaces of the arms 31F, 31R of the lever 30. Thus, the courses of the cam grooves can be designed without considering the avoidance of the interference of the two kinds of cam grooves. Therefore, a degree of freedom in design is higher.

Further, the front and rear second cam followers 17F, 17R on the moving plate 14 are at positions deviated in opposite directions along widthwise direction WD with respect to each other. Thus, there is no likelihood that the moving plate 14 will incline about the engaged positions of the second cam grooves 35F, 35R and the second cam followers 17F, 17R.

Figure 11:
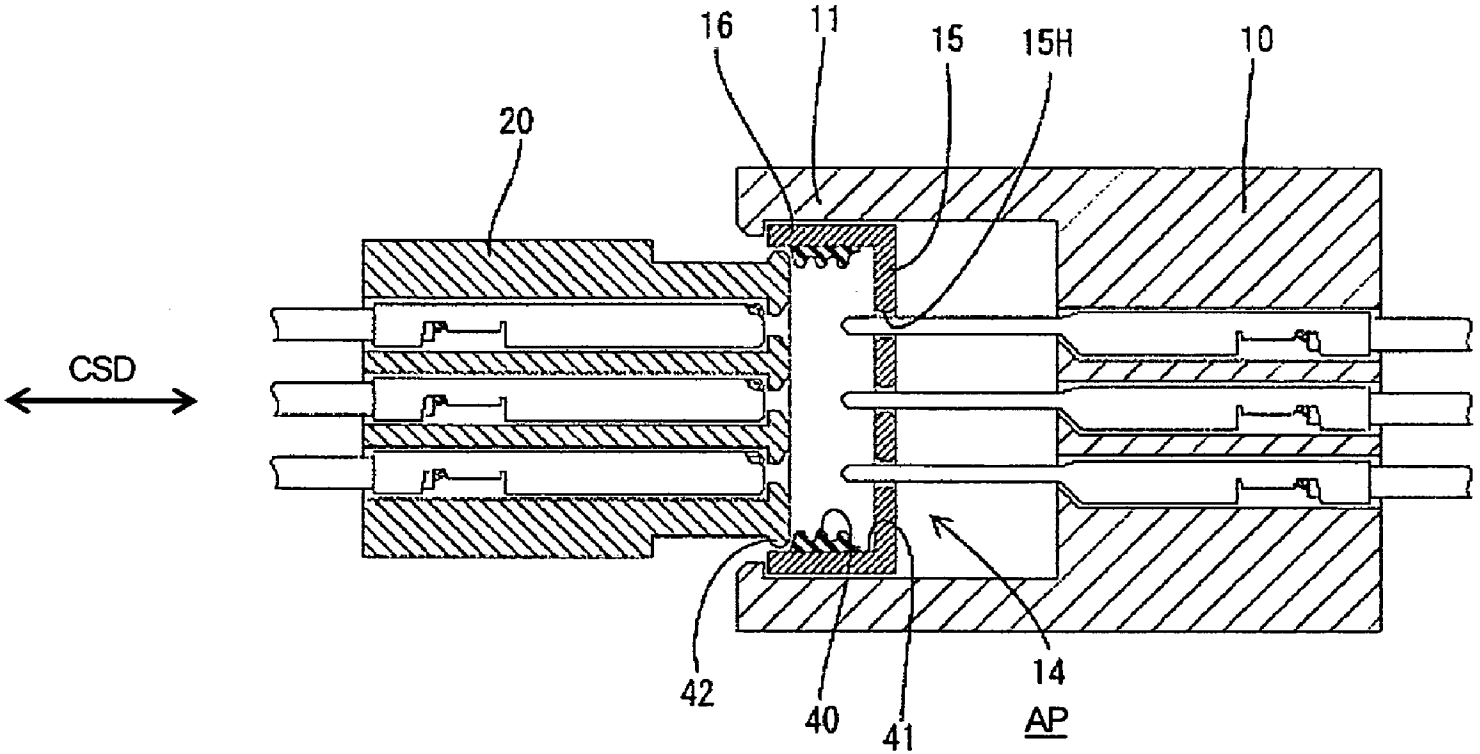
FIG. 11 is a section showing a state before two housings according to a second embodiment are connected.
Figure 12:
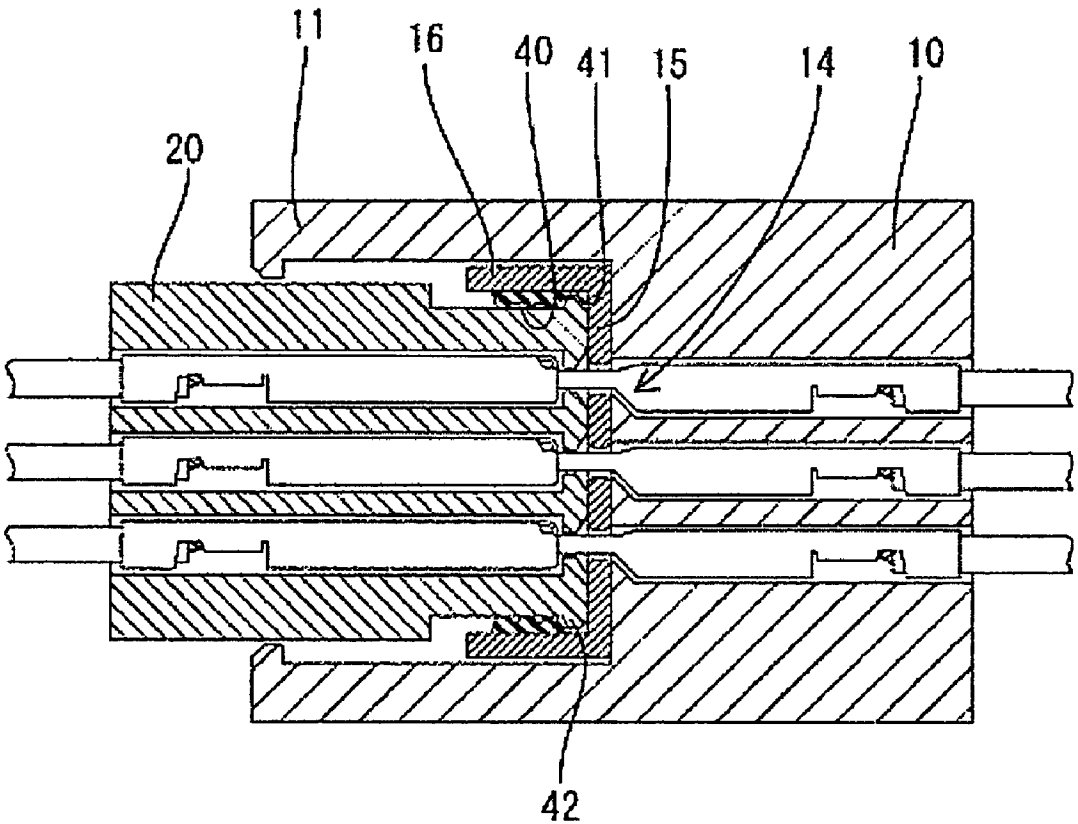
FIG. 12 is a section showing a state where the two housings according to the second embodiment are properly connected.
Figure 13:
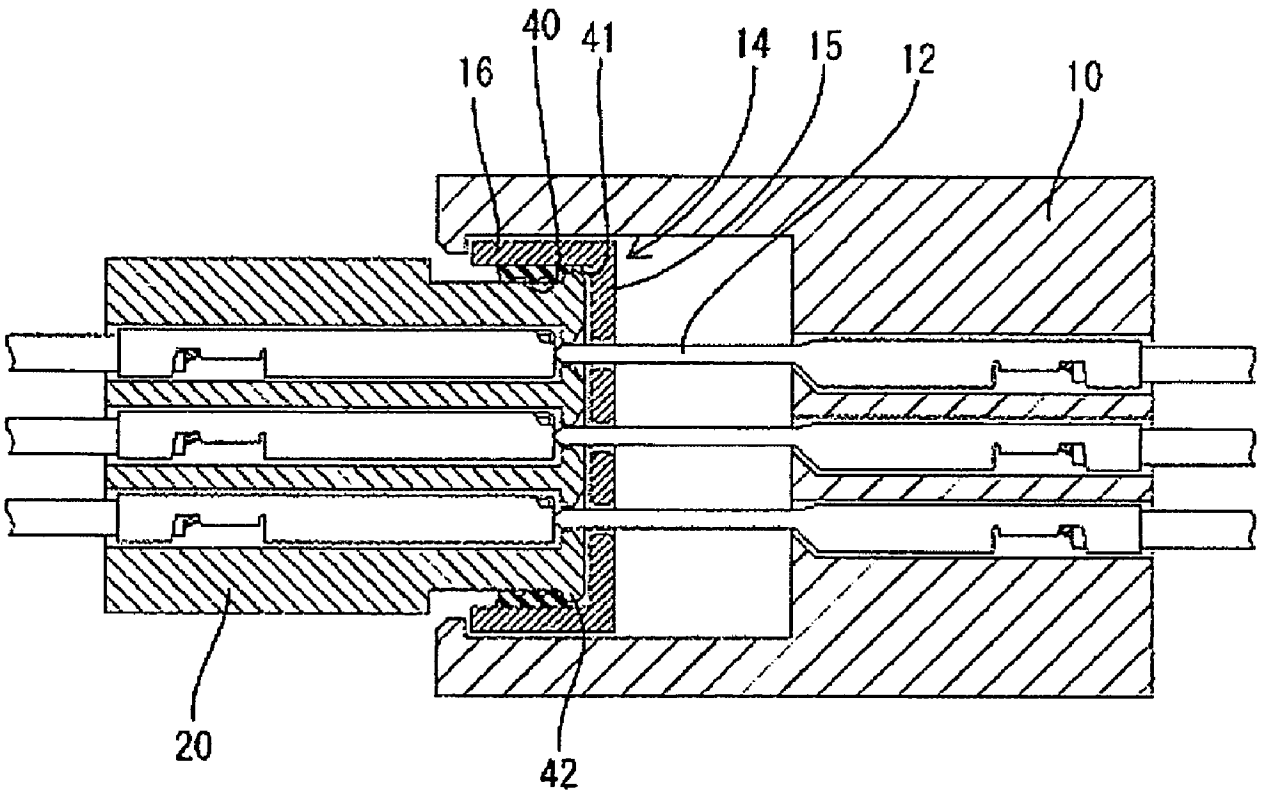
FIG. 13 is a section showing a state where the two housings according to the second embodiment are lightly fitted to each other.

A second embodiment of the invention is described with reference to FIGS. 11 to 13. In this second embodiment, a seal ring 40 for fluid- or waterproofing is provided in a recess 41 on the inner periphery of the surrounding wall 16 of the moving plate 14. A recess 41 is defined along the inner periphery of the surrounding wall 16 between the back end of the seal ring 40 and the main portion 15. A projection 42 is formed on the outer periphery of the leading end of the female housing 20 with respect to the connecting direction and is engageable with the recess 41. The projection 42 may be provided around the substantially entire outer periphery of the leading end of the female housing 20 or only part thereof.

The two housings 10, 20 are fit lightly together with the moving plate 14 at the aligning position AP (see FIG. 11) to insert the first cam followers 13F, 13R into the entrances of the first cam grooves 34F, 34R and to insert the second cam followers 17F, 17R into the entrances of the second cam grooves 35F, 35R. The projection 42 engages the recess 41, as shown in FIG. 13, to prevent relative movements of the female housing 20 and the moving plate 14 in the connecting and separating directions CSD. Thus, the female housing 20 and the male housing 10 can be held temporarily in their lightly fitted state. This can facilitate a succeeding operation of transferring the hand holding the female housing 20 to the lever 30. With the recess 41 and the projection 42 engaged, the moving plate 14 and the female housing 20 move in the receptacle 11 without making any relative movement while the lever 30 is rotated.

Other elements that are similar to the first embodiment are not described, but are identified by the same reference numerals.

The invention is not limited to the above described and illustrated embodiments. For example, the following embodiments are also embraced by the technical scope of the present invention as defined by the claims.

Although the lever includes two arms in the foregoing embodiments, the lever may be a single plate according to the present invention.

The two second cam followers of the moving plate are at the positions deviated in opposite directions along the widthwise direction in the foregoing embodiments. However, the second cam followers may be arranged at the widthwise middle position according to the present invention.

The operable member described above is a lever rotatably provided on one of the housings. However, a different operable member may be provided, such as a slider that is substantially linearly movable at an angle to the connecting and separating directions CSD or movable along a nonlinear path, such as a substantially elliptical path.

Although the preferred lever is on the female housing it may be on the male housing.

What is claimed is:

1. A connector, comprising:

a first housing with first terminal fittings, at least one first cam follower formed on the first housing;

a second housing connectable with the first housing;

a moving plate movable in the first housing while permitting the first terminal fittings to pass therethrough, at least one second cam follower formed on the moving plate;

a lever supported on the second housing for moving along an outer surface of the second housing, the lever having at least one inner surface and at least one outer surface opposite to the inner surface, at least one first cam groove formed on the outer surface of the lever and engageable with the first cam follower, and at least one second cam groove formed on the inner surface of the lever and being engageable with the second cam follower, entrances of the first and second cam grooves being offset from one another in a rotational direction of the lever, movement of the lever moves the second housing and the moving plate towards or away from the first housing.

2. The connector of claim 1, wherein the lever includes two arms on opposite sides of the second housing, the at least one second cam groove comprises two cam groove formed respectively in the inner surfaces of the arms.

3. The connector of claim 1, wherein the at least one second cam follower comprises two second cam followers formed on the moving plate at positions deviated in opposite directions from a widthwise middle position.

4. The connector of claim 1, wherein a seal ring is provided on the moving plate.

5. The connector of claim 1, wherein the first cam followers and the second cam followers are asymmetrically arranged with respect to a width direction.

6. The connector of claim 1, wherein the first housing includes a receptacles at least partly surrounding the first terminal fittings, and the moving plate is movable in the receptacle while permitting the first terminal fittings to pass therethrough.

7. The connector of claim 6, wherein the first cam follower projects from an inner peripheral surface of the receptacles.

8. The connector of claim 7, wherein the second cam follower projects towards the inner peripheral surface of the receptacle.

* * * * *